US009542913B2

(12) United States Patent
Wang

(10) Patent No.: US 9,542,913 B2
(45) Date of Patent: Jan. 10, 2017

(54) COMMON VOLTAGE DRIVING COMPENSATION UNIT, METHOD AND DISPLAY PANEL USING THE SAME

(71) Applicants: BOE TECHNOLOGY GROUP CO., LTD., Beijing (CN); BEIJING BOE DISPLAY TECHNOLOGY CO., LTD., Beijing (CN)

(72) Inventor: Jieqiong Wang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 204 days.

(21) Appl. No.: 14/496,812

(22) Filed: Sep. 25, 2014

(65) Prior Publication Data

US 2015/0356951 A1 Dec. 10, 2015

(30) Foreign Application Priority Data

Jun. 10, 2014 (CN) ..... 2014 1 0255374

(51) Int. Cl.
*G09G 5/18* (2006.01)
*G09G 3/36* (2006.01)

(52) U.S. Cl.
CPC ..... *G09G 5/18* (2013.01); *G09G 3/3696* (2013.01); *G09G 2310/0232* (2013.01); *G09G 2320/0223* (2013.01); *G09G 2320/0242* (2013.01)

(58) Field of Classification Search
None
See application file for complete search history.

(56) References Cited

U.S. PATENT DOCUMENTS 4,673,807 A * 6/1987 Kobayashi ..... G01N 21/5907 250/214 AG
2008/0252584 A1* 10/2008 Maeda ..... G09G 3/3648 345/94

(Continued)

FOREIGN PATENT DOCUMENTS

CN 102891655 A 1/2013
CN 103426413 A 12/2013

(Continued)

OTHER PUBLICATIONS

English Translation of first Chinese Office Action dated Oct. 10, 2015, for corresponding Chinese Application No. 201410255374.8.

*Primary Examiner* — Kumar Patel
*Assistant Examiner* — Amy C Onyekaba
(74) *Attorney, Agent, or Firm* — Kinney & Lange, P.A.

(57) ABSTRACT

A common voltage driving compensation unit is disclosed, comprising: an operational amplifier and a controller, wherein an in-phase input terminal and a reverse-phase input terminal of the operational amplifier are inputted a common voltage and a feedback voltage respectively. Multiple paths are provided in parallel between the reverse-phase input terminal and a first output terminal, and each path including an analog switch and a resistor. The controller is configured to control a combination of on and off of the analog switches based on a range to which the count value of the CPV signal belongs. The common voltage driving compensation unit is configured to produce corresponding amplification ratios based on the combination, so as to provide common voltages with corresponding amplification ratios for the compensation of the common electrodes in different display areas. For a display panel with a heavy-load, the fluctuation coupling of the common electrodes may be compensated.

9 Claims, 5 Drawing Sheets

(56) References Cited

U.S. PATENT DOCUMENTS

| | | | | |
|---|---|---|---|---|
| 2008/0303770 | A1* | 12/2008 | Oke | G09G 3/3655 345/92 |
| 2012/0162184 | A1* | 6/2012 | Kim | G09G 3/3655 345/212 |
| 2014/0028535 | A1* | 1/2014 | Min | G09G 3/18 345/87 |

FOREIGN PATENT DOCUMENTS

| | | | |
|---|---|---|---|
| CN | 103578439 | A | 2/2014 |
| KR | 20080062926 | A | 7/2008 |

* cited by examiner

COMMON VOLTAGE DRIVING COMPENSATION UNIT, METHOD AND DISPLAY PANEL USING THE SAME

TECHNICAL FIELD

The present disclosure relates to display technology, and particularly to a common voltage driving compensation unit, a method and a display panel using the same.

BACKGROUND

As an application field of Thin Film Transistor Liquid Crystal Display (TFT-LCD) becomes much broader, technologies like a large scale LCD, a large aperture opening ratio LCD and Gate Driver on Array (GOA) develop greatly. However, a display panel with the large scale and large aperture opening ratio as stated above also has a problem regarding picture quality.

In order to improve the quality of pictures, it is generally needed to compensate common electrodes. FIG. 1 shows a structural diagram of a display panel implementing the common electrode compensation conventionally. A common electrode bus 01 is arranged peripherally around a display area 00 on the display panel of TFT-LCD to implement common electrode connections on the display panel. Source driver circuits 02 (also referred to as a source driver IC) are provided outside a top portion of the common electrode bus 01. Gate driver circuits are provided outside both side of the common electrode bus 01. Because gate drivers are usually manufactured using the GOA technology, GOA circuits 03 are provided on both sides of the display area 00. On the outside of the GOA circuits 03, a feedback signal line is provided, which is connected to the common electrode bus 01 to input a feedback voltage to the common voltage driving compensation units 05. The common voltage driving compensation units 05 are used to compensate the source driver circuits. FIG. 2 shows a principle diagram of a common voltage driving compensation unit 05, in which the common voltage driving compensation unit 05 includes an operational amplifier, an in-phase input terminal 051 at which a common electrode voltage is inputted, a reverse-phase input terminal 052 at which a feedback voltage provided by the feedback signal line is inputted, and an output terminal 053 at which a compensated common electrode voltage is outputted.

As for a display panel with a heavy-load, a common electrode compensation (i.e. Vcom compensation) with a higher amplification ratio is used in general. However, uniform compensation on the whole display panel can't be achieved with the conventional Vcom compensation manners, and a reddish phenomenon is caused on the display panel at an end near to the source driver circuit (i.e. a near end) due to over-compensation. In contrast, at an end far from the source driver circuit (i.e. a far end), a greenish phenomenon is caused on the display panel due to under-compensation, and thus a picture quality is degraded.

SUMMARY OF THE INVENTION

Technical Problem to Solve

A technical problem to be solved by the present disclosure is to suppress fluctuation coupling of a common electrode so as to achieve uniform compensation and hence improve the picture quality.

Technical Solution

In order to solve the technical problem, the disclosure provides a common voltage driving compensation unit, comprising: an operational amplifier, including an in-phase input terminal, a reverse-phase input terminal and a first output terminal, wherein the in-phase input terminal is inputted a common voltage, the reverse-phase input terminal is inputted a feedback voltage, a plurality of parallel connected paths are provided between the reverse-phase input terminal and the first output terminal, and each path including an analog switch and a resistor; and a controller configured to generate control signals according to an area where a current scan area is positioned, to control on and off of the analog switch on each path, so as to amplify the common voltage with a corresponding amplification ratio, wherein, the area where the current scan area is positioned, is determined based on a scan line driving clock signal and a frame start signal received.

Preferably, the resistors on the plurality of paths have same or different resistances.

Preferably, each of the plurality of analog switches may include: an input terminal, connected to the reverse-phase input terminal; a second output terminal, connected to a first terminal of corresponding resistor, a second terminal of the corresponding resistor is connected to the first output terminal; and a control terminal, configured to receive the control signal from the controller.

Preferably, the controller may include: a first input terminal, connected to a scan line driving clock signal line to receive the scan line driving clock signal; a second input terminal, connected to frame start signal line to receive the frame start signal; the controller is configured to count the scan line driving clock signal based on the frame start signal, and to output corresponding control signals based on a value range to which a count value of the scan line driving clock signal belongs.

Preferably, the controller may further include: a plurality of output terminals, configured to output the control signals, wherein a number of the plurality of output terminals corresponds to a number of the plurality of paths.

In order to solve the technical problem, the disclosure also provides a display panel, comprising a timing controller, and a common voltage driving compensation unit as described above, wherein the timing controller is configured to provide the common voltage driving compensation unit with the scan line driving clock signal and the frame start signal.

In order to solve the technical problem, the disclosure also provides a common voltage driving compensation method, comprising:

- dividing a display area into a plurality of areas based on a distance between the common voltage driving compensation unit and the source driver;
- counting the scan line driving clock signals, and setting at least two predetermined threshold ranges based on a result of the dividing;
- controlling a combination of on and off of the analog switches on respective paths based on the predetermined threshold range to which the count value belongs, so as to compensate the inputted common voltage with corresponding amplification ratios, respectively.

Preferably, the method further comprises starting the counting of the scan line driving clock signals when the frame start signal inputted to the controller is at a high level.

Beneficial Effects

According to the embodiments of the disclosure, based on an idea of multi-path design and area-dependent compensation, each common voltage driving compensation unit generates a corresponding amplification ratio according to the combination of on and off of respective analog switch, and common voltages with corresponding amplification ratios are respectively provided to the common electrodes in different areas by controlling the combination of on and off of respective analog switch based on the range to which the count value of the scan line driving clock signals belongs, so as to compensate and suppress the fluctuation coupling of the common electrodes during the common electrode compensating process for the display panel with a heavy-load, and eliminate the reddish and heat generation phenomenon on the display panel due to over-compensation and improve the picture quality.

THE DESCRIPTION OF EMBODIMENTS

The disclosure will be further described in detail with reference to the drawings and embodiments. The embodiments are exemplary only, and are not to limit the scope of the disclosure.

Figure 1:
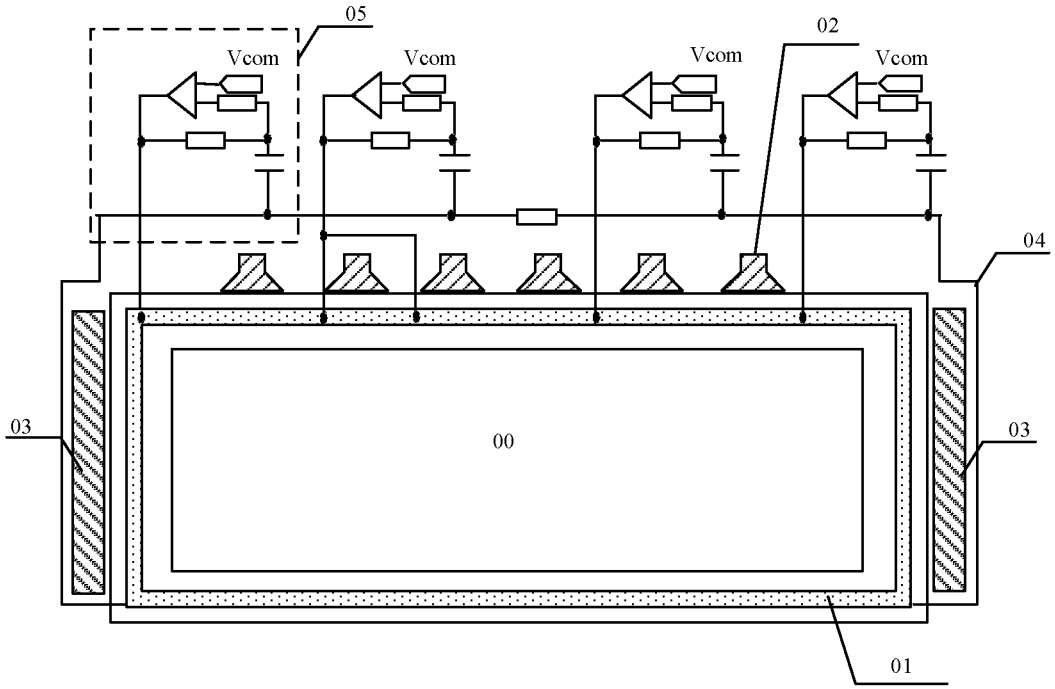
FIG.1 Prior Art
FIG. 1 is a structural diagram showing a display panel to which a common voltage driving compensation is applied conventionally.
Figure 2:
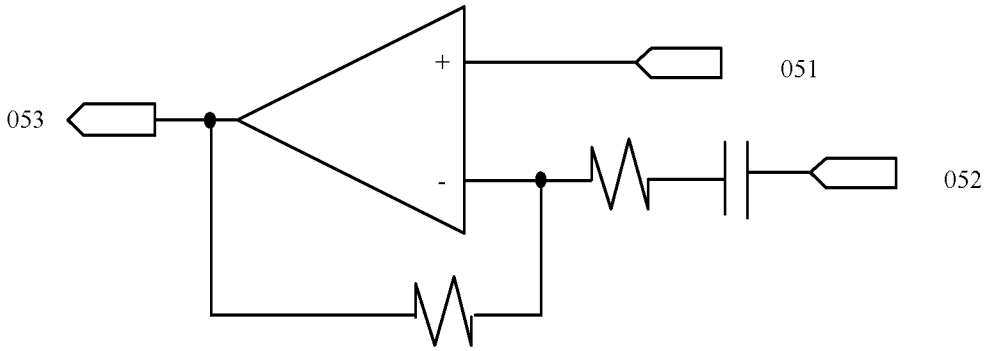
FIG.2 Prior Art
FIG. 2 is a principle diagram showing a conventional common voltage driving compensation unit.
Figure 3:
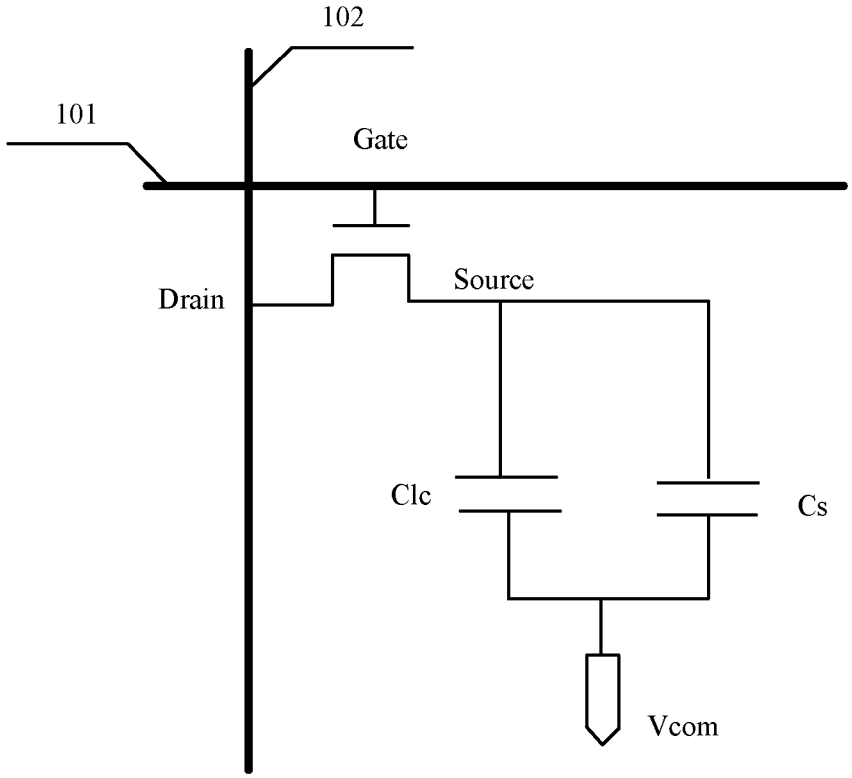
FIG. 3 is a structural principle diagram showing a sub-pixel structure for displaying.

An array base plate of a display panel has a TFT array structure. As shown in FIG. 3, for each sub pixel, Gate of TFT is connected to Scan line 101, Drain is connected to Data line 102, and Source is connected to a common electrode Vcom via two parallel connected capacitors, one of which is a storage capacitor Cs, the other is a pixel capacitor Clc. Scan line 101 and Data line 102 are crossed to form the sub pixels. A basic operation principle of the sub pixel with the above structure is: applying valid scan signals to Scan line 101 line by line to enable the corresponding line; when the scan signal for the corresponding line is valid, writing data into the corresponding scan line via Data line 102, and when the scan signal in this Scan line 101 is deactivated, storing the written data into all pixels in this line via the storage capacitor Cs. The voltage difference across the pixel capacitor Clc is information regarding a brightness to be displayed at this sub pixel. However, a coupling capacitance is usually existed between the data line and the common electrode line, especially for the display panel with a heavy-load. This will lead to a larger coupling area, and thus larger coupling capacitance. Therefore, a common electrode will be coupling effected by a data line whenever data is written into a line, this leads to a coupling phenomenon between the common electrode line and the data line. Therefore the data on the common electrode line would be destructed as a polarity and an intensity of the data on the data line is deflected. Because of large sizes of the display panel with a heavy-load, a corresponding amplification ratio is needed for a different area. Thus, the common voltage of the common electrode will be varied during the compensating for the sake of non-uniform compensation, and this will degrade the picture quality. Those skilled in the art will appreciate that, although the above description takes the gate drivers as an example, similar situation applies to the source drivers.

According to one embodiment, a common voltage driving compensation unit is provided, which may include an operational amplifier 10 and a controller 40. The operational amplifier 10 comprises an in-phase input terminal 051, a reverse-phase input terminal 052 and a first output terminal 053. The in-phase input terminal 051 receives the common voltage, and the reverse-phase input terminal 052 receives the feedback voltage. A plurality of paths are connected in parallel between the reverse-phase input terminal 052 and the first output terminal 053, and each path includes a corresponding analog switch 20 and a corresponding resistor 30. The resistance of each resistor 30 may be the same or different for each of the paths. The controller 40 controls a combination of on and off of the respective analog switches according to a range to which a count value of the scan line driving clock signal belongs. The principle diagram of the common voltage driving compensation unit is shown in FIG. 4.

Because there is only one resistor connected between the reverse-phase input terminal and the output terminal (i.e. the first output terminal in the embodiment) in the conventional compensation circuit, it is not able to compensate the common electrodes in various areas in the panel with the corresponding amplification ratios, so as not to achieve area-dependent compensation. Therefore, compensating for the fluctuation coupling can't be uniformized. In the embodiment of the present invention, a plurality of analog switches are provided in parallel in the common voltage driving compensation unit, instead of an original structure with single path. A plurality of paths are formed with a plurality of switches and a plurality of corresponding resistors. Therefore, the corresponding amplification ratios could be obtained for the various areas as desired so as to compensate the common electrodes, thereby compensating and suppressing the fluctuation coupling of the common electrode. With the structure, the reddish and heat generation phenomenon on the display panel due to overcompensation may be eliminated and the picture quality is improved.

Figure 4:
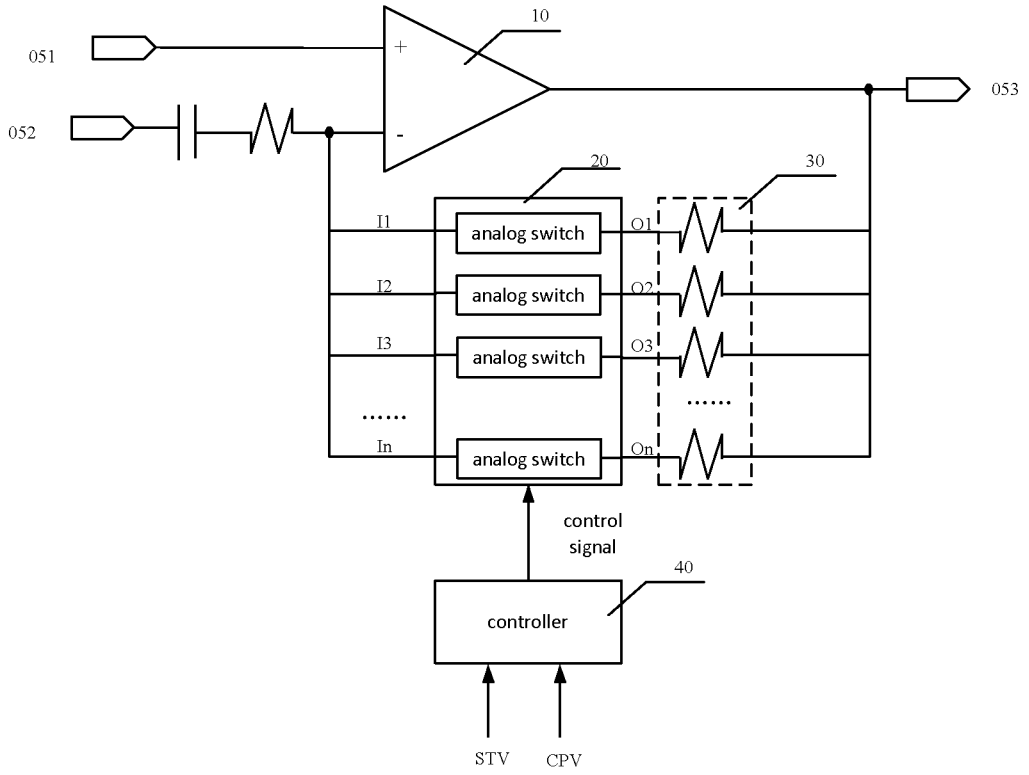
FIG. 4 is a principle diagram showing a common voltage driving compensation unit according to one embodiment of the present invention.

Preferably, a feedback resistor and a capacitor are provided between the in-phase input terminal 051 and the reverse-phase input terminal 052, as shown in FIG. 4. The validity of the resistors in the paths can be determined by the analog switches, thereby achieving various equivalent resistances between the reverse-phase input terminal 052 and the output terminal 053. The ratio of the equivalent resistances to the feedback resistances further determines the various amplification ratios to amplify the common voltage inputted correspondingly.

Figure 5:
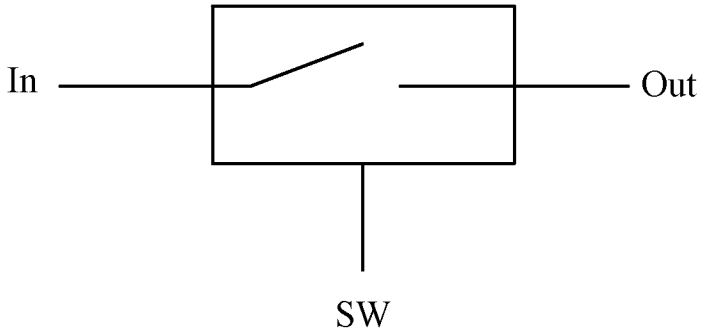
FIG. 5 is a structural diagram showing a switch in FIG. 4.

Additionally, FIG. 5 shows a structural diagram of an analog switch according to the embodiment. The analog switch includes an input terminal In, a second output terminal Out and a control terminal SW. The input terminal In is connected to the reverse-phase input terminal 052 of the operational amplifier 10 to receive a feedback signal of the common electrode, the second output terminal Out is connected to a first terminal of a corresponding resistor, a second terminal of the corresponding resistor is connected to the first output terminal 053 of the operational amplifier 10, and the control terminal SW is configured to receive the control signal. An operation state of a multi-path analog switch is controlled according to the control signal inputted to the control terminal SW.

Preferably, in the embodiment, the controller 40 is a circuit with two inputs and multiple outputs. The controller 40 includes a first input terminal 41, a second input terminal 42 and a plurality of output terminals. The first input terminal 41 is connected to the scan line driving clock signal line to receive the scan line driving clock signal (e.g. CPV signal in the example of gate drivers), a second input terminal 42 is connected to the frame start signal line to receive the frame start signal (e.g. STV signal in the example of gate drivers). When a count value of the scan line driving clock signal is in a certain range, the controller 40 configured to generate a corresponding control signal. The controller may be configured to, when the frame start signal inputted to the controller is at a high level (for example, a rising edge of the STV signal is detected), start counting the received scan line driving clock signals and obtain the control signals to be outputted.

Preferably, the output terminals of the controller 40 output the control signals. The number of the plurality of output terminals corresponds to the number of the plurality of paths. For example, when a certain terminal is outputting a signal at a high level, the analog switch on the corresponding path is turned on, and when an output terminal is outputting a signal at a low level, the analog switch on the corresponding path is turned off. By transmitting corresponding control signals for the analog switches on corresponding paths via the output terminals, a combined control of on and off of respective analog switches is implemented, which further leads to different amplification ratios, so as to achieve the purpose of area-dependent compensation.

Figure 6:
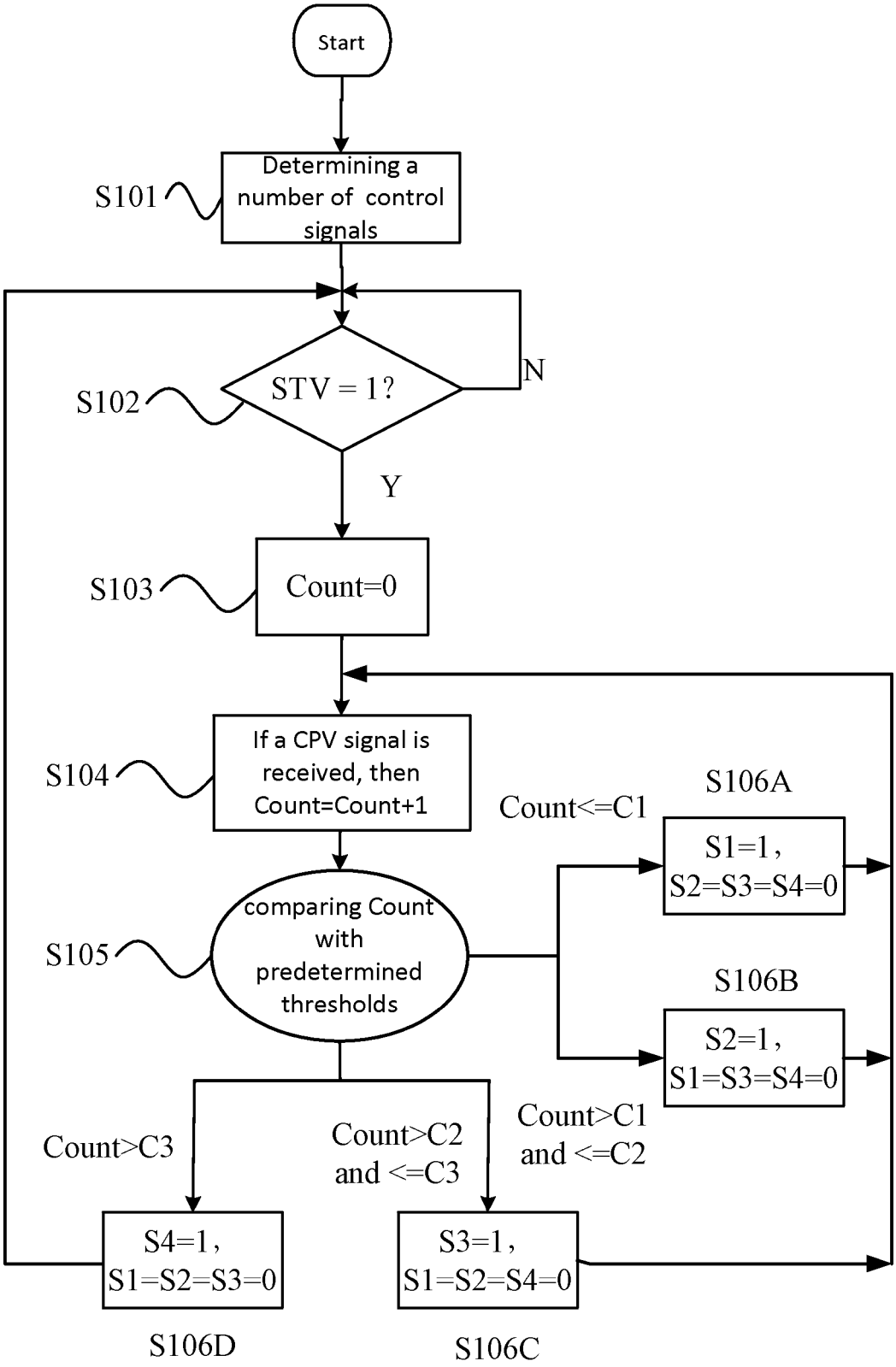
FIG. 6 shows a flow chart for generating a control signal according to one embodiment of the present invention, in which four areas are taken as an example.

State machines of the two inputs (e.g. SW and CPV) could be used to generate the control signals. In particular, taking a panel with 1920*1080 resolution as an example, the whole display area may be divided into four areas for 1080 scan lines, wherein lines 1-270 are grouped as a first area, lines 271-540 are grouped as a second area, lines 541-810 are grouped as a third area, and lines 811-1080 are grouped as a fourth area. A flow chart for generating control signal is shown in FIG. 6.

At S101, determining a number of the control signals based on a number of the areas obtained. For example, there are four areas in this example, and a set of control signal includes S1, S2, S3, S4.

At S102, determining whether the STV signal is equal to 1. When the STV signal is 0, the STV signal is invalid, indicating that there isn't any new frames to be displayed, thereby wait for the next one. When the STV signal is 1, the STV signal is valid, indicating a new frame is to be displayed, goes to step S103.

At S103, resetting the count value Count of a counter to 0, and going to step S104.

At S104, incrementing the count value Count based on a received CPV signal, and going to step S105. CPV signal is a pulse signal, therefore rising edges or falling edges of the CPV signals may be counted.

At S105, comparing the current count value Count with predetermined thresholds. When the count value Count is smaller than or equals to C1 (C1 is set to be 270 in the example), the current scanning area is within the first area, then proceed to step S106A, in which the control signals are set as S1=1, S2=S3=S4=0 (a first state), "0" is low level, "1" is high level, which means only the first analog switch is on, and the others are off.

Then, return to step S104, continue to increment the count value Count according to a received driving clock signal CPV. When the count value Count is larger than C1 and smaller than or equals to C2 (C2 is set to be 540 in the example), the current scanning area is within the second area, then proceed to step S106B, in which the control signals are set as S2=1, S1=S3=S4=0 (a second state), which means only the second analog switch is on, and the others are off.

Then, return to step S104, continue to increment the count value Count according to a received CPV signal. When the count value Count is larger than C2 and smaller than or equals to C3 (C3 is set to be 810 in the example), the current scanning area is within the third area, then proceed to step S106C, in which the control signal are set as S3=1, S1=S2=S4=0 (a third state), which means only the third analog switch is on, and the other three are off.

Then, return to step S104, continue to increase the count value Count according to a received gate driving clock signal CPV, and when the count value Count is larger than C3, the current scanning area is within the fourth area, then proceed to step S106D, wherein the control signals are set as S4=1, S1=S2=S3=0 (a fourth state), which means only the fourth analog switch is on, and the others are off.

Because STV signal is a pulse signal, it usually has changed from high level to low level 0 when scanning the fourth area. Therefore, return to step S102, to determine if the frame start signal STV equals to 1. If the STV signal is 0, it is indicated that the current frame is still being scanned, thereby remain in the fourth state. If the STV signal is 1, it is indicated that a new frame is to be scanned. Therefore, the count value Count is reset to 0, and the operations in the above steps of S103-S106 are performed.

If the first scan line is the near end (i.e. an end near to source driver), and the 1080th scan line is the far end (i.e. an end far from source driver), then a smaller amplification ratio is used to compensate the common electrode in the first area where the first line is positioned, thereby the resistor on the first path may be set to have the smallest resistance. Similarly, a larger amplification ratio is used to compensate the common electrode in the fourth area where the 1080th line is positioned, thereby the resistor on the fourth path may be set to have the largest resistance. The resistances of respective resistors on the paths are arranged in an ascending order from the first to the fourth. When the scan lines activated are lines 1-270, the first analog switch is turned on, and other switches are off; when the scan lines activated are lines 271-540, the second analog switch is turned on, and other switches are off; when the scan lines activated are lines 541-810, the third analog switch is turned on, and other switches are off; and when the scan lines activated are lines 811-1080, the fourth analog switch is turned on, and other switches are off.

Figure 7:
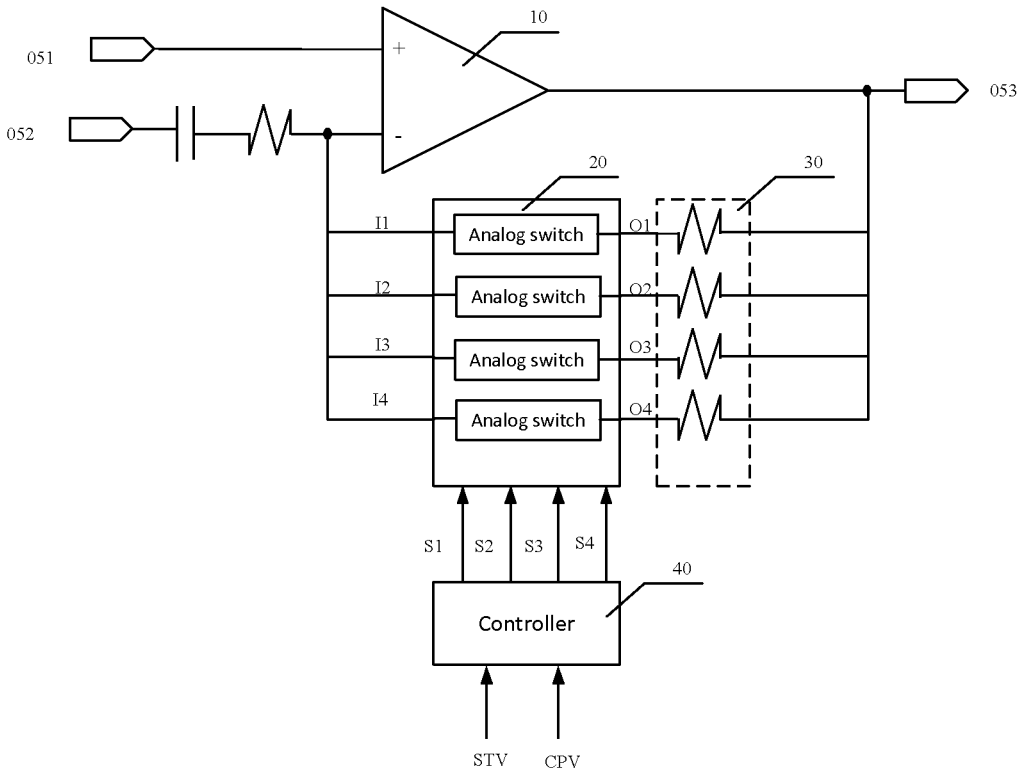
FIG. 7 is a principle diagram showing a common voltage driving compensation unit according to one embodiment of the present invention, in which four areas are taken as an example.

According to the above combinations of on and off, an appropriate amplification ratio may be obtained by allowing only one analog switch to be turned on each time, because the resistors on the four paths have different resistances. Those skilled in the art will appreciate that, the four resistors may have the same resistance as well, and the appropriate amplification ratios may be achieved by arranging the on and off of the analog switches in a different combination. A principle diagram of the common voltage driving compensation unit with the four divided areas is shown in FIG. 7. In particular, the multiplexing structure in the embodiment is used to implement the generation of four control signals. Certainly, the whole display area is not limited to be divided into four areas. Those skilled in the art will appreciate that any other configuration of the switch states and resistances may be adopted, as long as the closer it is to the source driver, the smaller an amplification ratio is needed for the common electrode compensation.

The received gate driving clock signals are counted during the compensation of the common electrodes, and an area being scanned is determined based on the range to which the count value belongs, so as to compensate and suppress the fluctuation coupling of the common electrodes, eliminate the reddish and heat generation phenomenon on display panel due to overcompensation and improve picture quality. This common voltage driving compensation unit is particularly applicable to the common electrode compensation of the display panel with a heavy-load.

The embodiment also provides a display panel, which may include a timing controller and a common voltage driving compensation unit according to the embodiment. The timing controller provides the common voltage driving compensation unit with the scan line driving clock signal and the frame start signal. The controller in the common voltage driving compensation unit counts the received scan line driving clock signals, and provides corresponding amplification ratios based on a range to which the count value belongs. The amplification ratio is based on a combination of on and off of the analog switches in the common voltage driving compensation unit. Particularly, the amplification ratio is associated with the ratio of the equivalent resistance of the parallel paths to the feedback resistance of the reverse-input terminal.

The area dividing is performed based on a distance between the common voltage driving compensation unit and a source driver, and the ranges of the gate driving clock signals are determined based on the area division.

In the display panel of the embodiment, the controller in the common voltage driving compensation unit takes STV signal and CPV signal as input data, and divides the display panel according to the counting of CPV signals, thereby different areas are compensated with corresponding amplification ratios, so as to uniformize compensation of the whole display panel, suppress the fluctuation coupling of the common electrode, avoiding over-compensation and under-compensation, and thus improve the picture quality.

Figure 8:
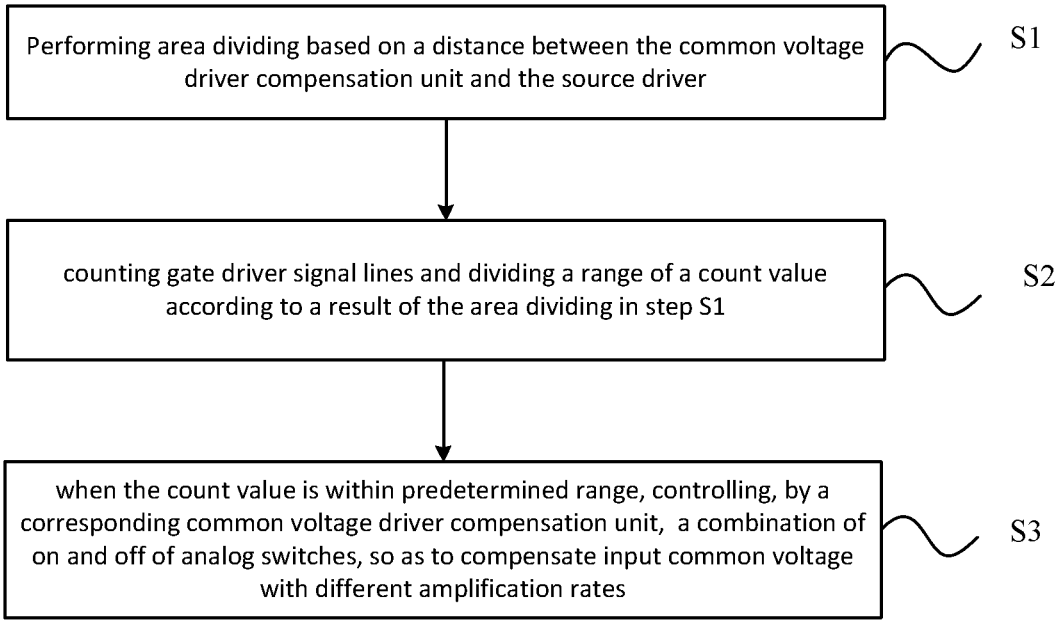
FIG. 8 shows a flow chart of a common voltage driving compensation method according to one embodiment of the present invention.

As shown in FIG. 8, the common voltage driving compensation method according to the embodiment may include:

step S1, dividing a display area based on a distance between the common voltage driving compensation unit and a source driver;

step S2, counting the scan line driving clock signal, and dividing a range of a count value according to a result of the dividing in step S1. When the frame start signal is at a valid level (e.g. high level), starting to count the scan line driving clock signal. As a frame synchronization signal, the frame start signal means starting to display a new frame. Scan line driving clock signal line is connected to a scan driver circuit for the display panel. Each scan line driving clock signal is acted as a synchronization signal for a corresponding scan line in the pixel structure;

step S3, based on the count value being within different preset ranges, the common voltage driving compensation unit controlling a combination of on and off of analog switches on corresponding paths, so as to amplify the input common voltage with the corresponding amplification ratios.

Additionally, at step S1, a common voltage driving compensation unit which is closer to the source driver is called a near end, whereas a common voltage driving compensation unit which is far from the source driver is called a far end, and the number of the areas obtained from dividing may be set on demand. Generally, at least two areas are obtained, i.e. the near end and the far end. For a display panel with a high resolution, at least three areas are obtained, i.e. a far end, a near end and an area between the far end and the near end, and the area between the far end and the near end may be further divided. Moreover, the dividing may be performed evenly or unevenly.

For example, when STV signal is at a high level, counting of the CPV signals is started. According to the number of the scan lines on the display panel, the display panel is divided into at least three areas, and each area corresponds to a switch. If three areas are obtained by division, then a first area is at the near end, a third area is at the far end, and a second area is between the near end and the far end. If more than three areas are obtained by division, then the two edge areas are located at respectively the near end and the far end, and a multiple areas may be located between the near end and the far end.

Additionally, at step S2, the CPV signals are counted. Based on the count value being within different preset ranges, the combination of on and off of the corresponding analog switches on the paths in the common voltage driving compensation unit is controlled. The amplification ratio is determined by a ratio of the equivalent resistance of the parallel paths to the resistance of the feedback resistor connected to the reverse-input terminal. Because the resistances on the corresponding paths may be same or different with each other, corresponding amplification ratios are provided for the different areas.

Area-dependent compensation is implemented to the different areas by using different amplification ratios, as in the above embodiment, only one analog switch is turned on each time, whereas other analog switches are turned off, and the respective analog switch corresponds to a resistor with a certain resistance. Certainly, the area-dependent compensation may also be implemented in other ways. For example, two or more analog switches may be turned on at the same time, and the resistances of corresponding resistors may be same or different. Those skilled in the art can set various control signals for the operation of a state machine like that in FIG. 6. This is more useful in a situation where more areas are obtained by dividing. If the division is finer, and more areas are obtained, then it will not be necessary for one path to correspond to only one area. In contrast, the on and off of switches and the resistance of respective resistors may be designed in a flexible manner, as long as the equivalent resistance of the circuit formed by the paths are different. Therefore, less analog switches and resistors would be required.

The above embodiments only serve to explain the disclosure, rather than to limit the scope of the disclosure. Any modification or variation could be made to the disclosure by those skilled in relative art without departing from the spirits and principles of the invention. Therefore, all equivalent technical solutions belong to the scope of the disclosure, which is defined by the claims appended below.

What is claimed is:

1. A common voltage driving compensation unit, comprising:

an operational amplifier, including an in-phase input terminal, a reverse-phase input terminal and a first output terminal, wherein the in-phase input terminal is inputted a common voltage, the reverse-phase input terminal is inputted a feedback voltage, a plurality of parallel connected paths are provided between the reverse-phase input terminal and the first output terminal, and each path including an analog switch and a resistor; and a controller, configured to count a gate driving clock signal based on the frame start signal, and to output corresponding control signals based on a count value of the gate driving clock signal, to control on and off of the analog switch on respective paths, so as to amplify the common voltage with a corresponding amplification ratio, wherein the display area is divided into a plurality of areas based on a distance between the common voltage driving compensation unit and a source driver, and a plurality of value ranges of the count value of the gate driving clock signal are established to correspond to respective areas of the plurality of areas divided in the display area, so that the control signals are based on which of the plurality of value ranges that the count value of the gate driving clock signal belongs.

2. The common voltage driving compensation unit according to claim 1, wherein the resistors on the plurality of paths have different resistances from each other.

3. The common voltage driving compensation unit according to claim 2, wherein each of the plurality of analog switches comprises:

an input terminal, connected to the reverse-phase input terminal;

a second output terminal, connected to a first terminal of a corresponding resistor, a second terminal of the corresponding resistor is connected to the first output terminal; and a control terminal, configured to receive the control signals from the controller.

4. The common voltage driving compensation unit according to claim 1, wherein the controller comprises:

a first input terminal, connected to a gate driving clock signal line to receive the gate driving clock signal;

a second input terminal, connected to a frame start signal line to receive the frame start signal;

the controller is configured to count the gate driving clock signal based on the frame start signal, and to output corresponding control signals based on a value range to which a count value of the gate driving clock signal belongs.

5. The common voltage driving compensation unit according to claim 4, wherein the controller further comprises: a plurality of output terminals, configured to output the control signals, wherein a number of the plurality of output terminals corresponds to a number of the plurality of paths.

6. A display panel, comprising a timing controller, and a common voltage driving compensation unit according to claim 1, wherein the timing controller is configured to provide the common voltage driving compensation unit with the gate driving clock signal and the frame start signal.

7. A common voltage driving compensation method applied to a common voltage driving compensation unit according to claim 1, comprising:

dividing a display area into a plurality of areas based on a distance between the common voltage driving compensation unit and a source driver;

counting the gate driving clock signals, and setting at least two predetermined threshold ranges based on a result of the dividing of the display area into the plurality of areas; and controlling a combination of on and off of the analog switch on a respective path, by the common voltage driving compensation unit, based on the predetermined threshold range to which the count value belongs, so as to compensate common voltages inputted with corresponding amplification ratios.

8. The common voltage driving compensation method according to claim 7, further comprising, when the frame start signal input to the controller is at a high level, starting the counting of the gate driving clock signals.

9. The common voltage driving compensation unit according to claim 1, wherein the resistors on the plurality of paths have equal resistances.

* * * * *